US010968086B1

(12) United States Patent
Tennant

(10) Patent No.: US 10,968,086 B1
(45) Date of Patent: Apr. 6, 2021

(54) APPARATUS FOR LIFTING A VEHICLE TOP

(71) Applicant: Douglas W. Tennant, Norfolk, NE (US)

(72) Inventor: Douglas W. Tennant, Norfolk, NE (US)

( * ) Notice: Subject to any disclaimer, the term of this patent is extended or adjusted under 35 U.S.C. 154(b) by 567 days.

(21) Appl. No.: 15/823,291

(22) Filed: Nov. 27, 2017

(51) Int. Cl.
*B66F 7/00* (2006.01)
*B66F 7/26* (2006.01)
*B66F 7/08* (2006.01)
*B66F 7/06* (2006.01)

(52) U.S. Cl.
CPC ..... *B66F 7/26* (2013.01); *B66F 7/0625* (2013.01); *B66F 7/08* (2013.01)

(58) Field of Classification Search
CPC ..... B66F 1/00; B66F 1/06; B66F 3/00; B66F 3/24; B66F 3/28; B66F 5/00; B66F 7/00; B66F 7/04; B66F 7/10; B66F 9/00; B66F 9/08
See application file for complete search history.

(56) References Cited

U.S. PATENT DOCUMENTS 2,093,284 A * 9/1937 Mandl ..... B66F 3/08 72/54
3,931,956 A * 1/1976 Hawkins ..... B66C 23/48 254/8 B
4,749,324 A * 6/1988 Rulison ..... B66C 23/48 212/261
5,076,448 A * 12/1991 Ballard ..... B66C 23/48 212/261
D376,240 S * 12/1996 Finnigan ..... D34/33
6,010,299 A * 1/2000 Jesswein ..... B66F 5/00 254/8 R
D465,635 S * 11/2002 Hong ..... D34/28
6,598,855 B1 7/2003 Petrone et al.
7,296,787 B2 * 11/2007 Barrios ..... B25H 1/0014 254/133 R
9,463,967 B1 10/2016 Meyer
D857,813 S * 8/2019 Carpinelli ..... D21/694

OTHER PUBLICATIONS

Jeep Wrangler TJ Forum, TJ General Discussion, "Could I use this hyrdraulic shop crane to assist removing my hardtop?" https://wranglertjforum.com/threads/could-i-use-this-hydraulic-shop-crane-to-assist-removing-my-hardtop.4323/, Dated Mar. 23, 2017, 21 pages.
(Continued)

*Primary Examiner* — Lee D Wilson
(74) *Attorney, Agent, or Firm* — Suiter Swantz pc llo

(57) ABSTRACT

An apparatus for lifting a vehicle top is disclosed. The apparatus may include a base frame including two or more legs and one or more support structures couplable to the one or more legs at a selected angle. The apparatus may include a body frame including a main support and a lifting arm bracket couplable to the main support. The apparatus may include a lifting arm including a lifting platform couplable to a lifting support and one or more stabilizing linkages couplable to the lifting arm bracket, the lifting arm, and the lifting support. The lifting platform may engage an underside of a vehicle top and maintain an orientation substantially parallel to a ground surface as the lifting arm rotates about an axis through the lifting arm bracket.

17 Claims, 14 Drawing Sheets

(56) References Cited

OTHER PUBLICATIONS

CJ Off-Road, Lange Originals Hoist-A-Cart Jeep Wrangler JK 2007-2018, https://www.cjponyparts.com/lange-originals-hoist-a-cart-jeep-wrangler-jk-2007-2018/p/L14100/, Print Date Nov. 7, 2017, 5 pages.
Alien Technologies Corp, TopLiftPros, TopLift Pros Gallery, https://www.topliftpros.com/gallery, 2 pages.

* cited by examiner

APPARATUS FOR LIFTING A VEHICLE TOP

TECHNICAL FIELD

The present invention generally relates to lifting systems and, more particularly, to an apparatus for lifting a vehicle top.

BACKGROUND

Vehicles tops (e.g., hardtops, camper shells, pickup toppers, or the like) are typically too heavy and/or unwieldy for a single individual to remove from or set on the vehicle. Current hoisting systems known in the art are attachable to the vehicle top, hoisting the vehicle top into the air in a crane-like fashion. To accomplish this, the current hoisting systems known in the art are often permanently affixed to a select location (e.g., garage ceiling). In this regard, the place for removal, storage, and/or installation is limited to the select location. Additionally, permanently affixing the hoisting system to the select location may prohibit efficient usage of the select location when not removing the vehicle top. Further, permanently affixing the hoisting system to the select location may result in property damage and/or an inability to take the hoisting system with when moving from the property with the select location.

Therefore, it would be advantageous to provide a system and method that cures the shortcomings described above.

SUMMARY

An apparatus for lifting a vehicle top is disclosed, in accordance with one or more embodiments of the present disclosure. The apparatus may include a base frame. The base frame may include two or more legs. The base frame may include one or more support structures couplable to the one or more legs at a selected angle. The apparatus may include a body frame couplable to the base frame. The body frame may include one or more main supports. The body frame may include a lifting arm bracket couplable to the one or more main supports. The apparatus may include a lifting arm couplable to the lifting arm bracket. The lifting arm may include a lifting platform couplable to a lifting support. The lifting platform may engage an underside of a vehicle top. The lifting arm may include one or more stabilizing linkages couplable to the lifting arm bracket, the lifting arm, and the lifting support. The lifting arm may be rotatable about an axis through the lifting arm bracket. The lifting platform may maintain an orientation substantially parallel to a ground surface as the lifting arm rotates about the axis through the lifting arm bracket.

A system is disclosed, in accordance with one or more embodiments of the present disclosure. The system may include a vehicle top couplable to a vehicle. The system may include an apparatus for lifting the vehicle top. The apparatus may include a base frame. The base frame may include two or more legs. The base frame may include one or more support structures couplable to the one or more legs at a selected angle. The apparatus may include a body frame couplable to the base frame. The body frame may include one or more main supports. The body frame may include a lifting arm bracket couplable to the one or more main supports. The apparatus may include a lifting arm couplable to the lifting arm bracket. The lifting arm may include a lifting platform couplable to a lifting support. The lifting platform may engage an underside of a vehicle top. The lifting arm may include one or more stabilizing linkages couplable to the lifting arm bracket, the lifting arm, and the lifting support. The lifting arm may be rotatable about an axis through the lifting arm bracket. The lifting platform may maintain an orientation substantially parallel to a ground surface as the lifting arm rotates about the axis through the lifting arm bracket.

A method is disclosed, in accordance with one or more embodiments of the present disclosure. The method may include, but is not limited to, positioning a lifting apparatus behind a vehicle. The method may include, but is not limited to, engaging an underside of a vehicle top on the vehicle with a lifting platform on a lifting arm of the lifting apparatus. The method may include, but is not limited to, lifting the vehicle top to a raised position with the lifting arm of the lifting apparatus. The lifting platform may maintain an orientation substantially parallel to a ground surface as the vehicle top is lifted to the raised position. The method may include, but is not limited to, removing the lifting apparatus from behind the vehicle as the vehicle top is in the raised position.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A-6, an apparatus for lifting a vehicle top is described, in accordance with the present disclosure.

Embodiments of the present disclosure are directed to a portable and storable apparatus for lifting vehicle tops. Embodiments of the present disclosure are also directed to utilizing the apparatus for lifting vehicle tops on multiple types of vehicle tops and/or covers, where the lifting platform of the lifting arm interacts with the underside (e.g., ceiling) of the vehicle top. Embodiments of the present disclosure are also directed to maintaining a substantially planar orientation (e.g., an orientation substantially parallel to the ground) of the lifting arm at any angle during operation when lifting a vehicle top.

Figure 1A:
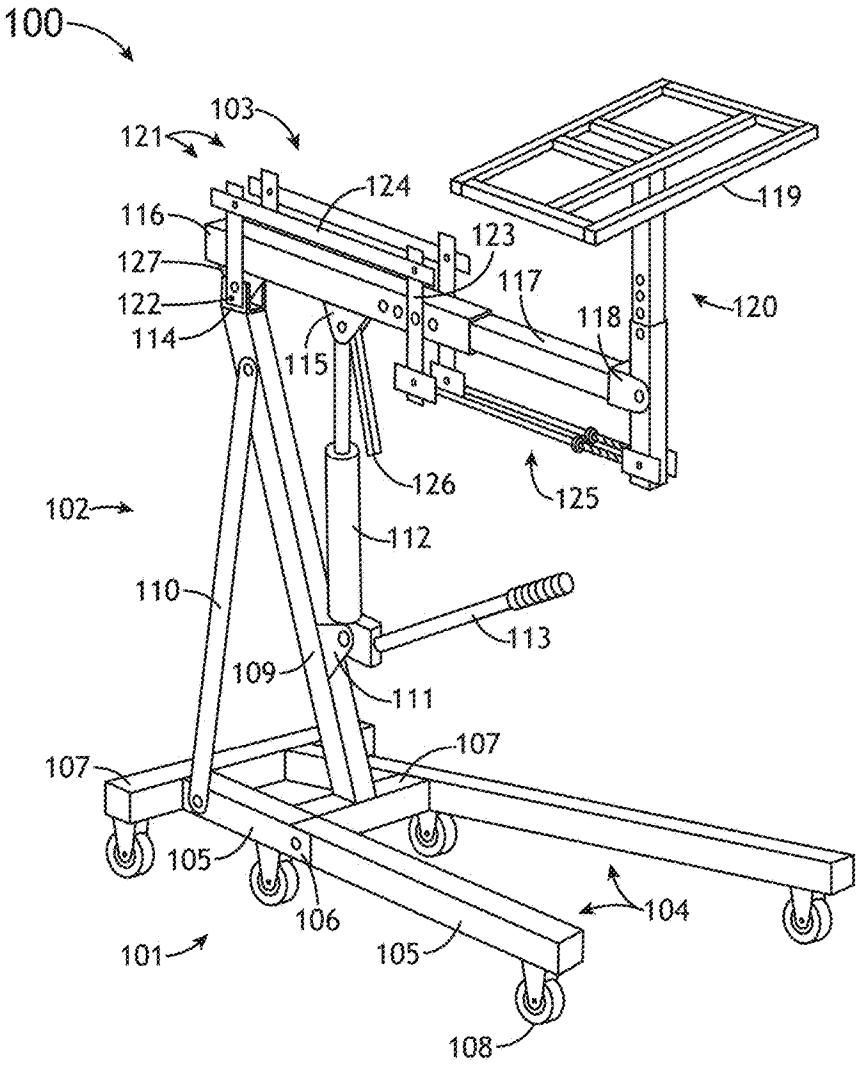
FIG. 1A illustrates an isometric view of an apparatus for lifting a vehicle top, in accordance with one or more embodiments of the present disclosure.
Figure 1B:
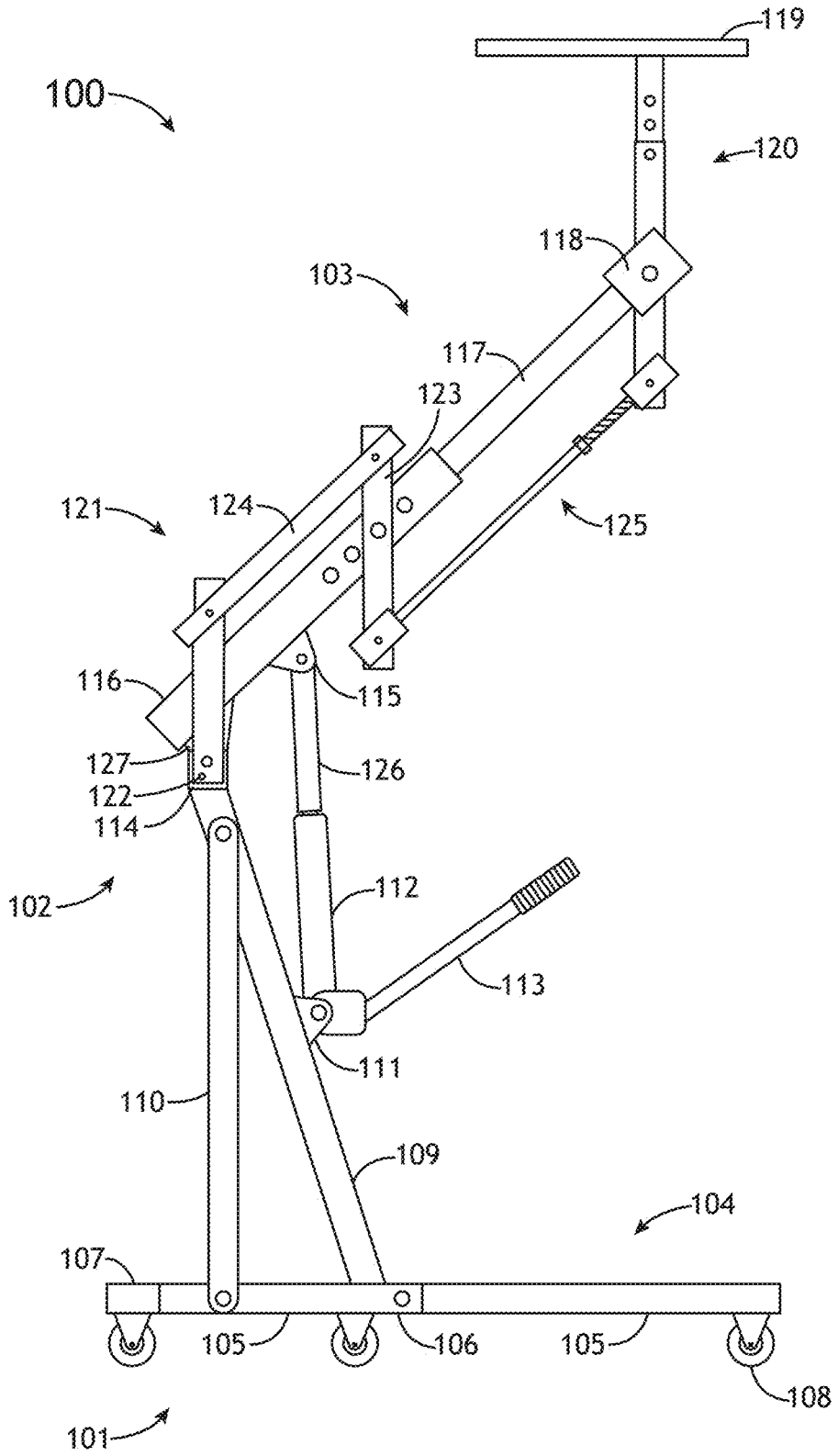
FIG. 1B illustrates a side view of an apparatus for lifting a vehicle top, in accordance with one or more embodiments of the present disclosure.
Figure 1C:
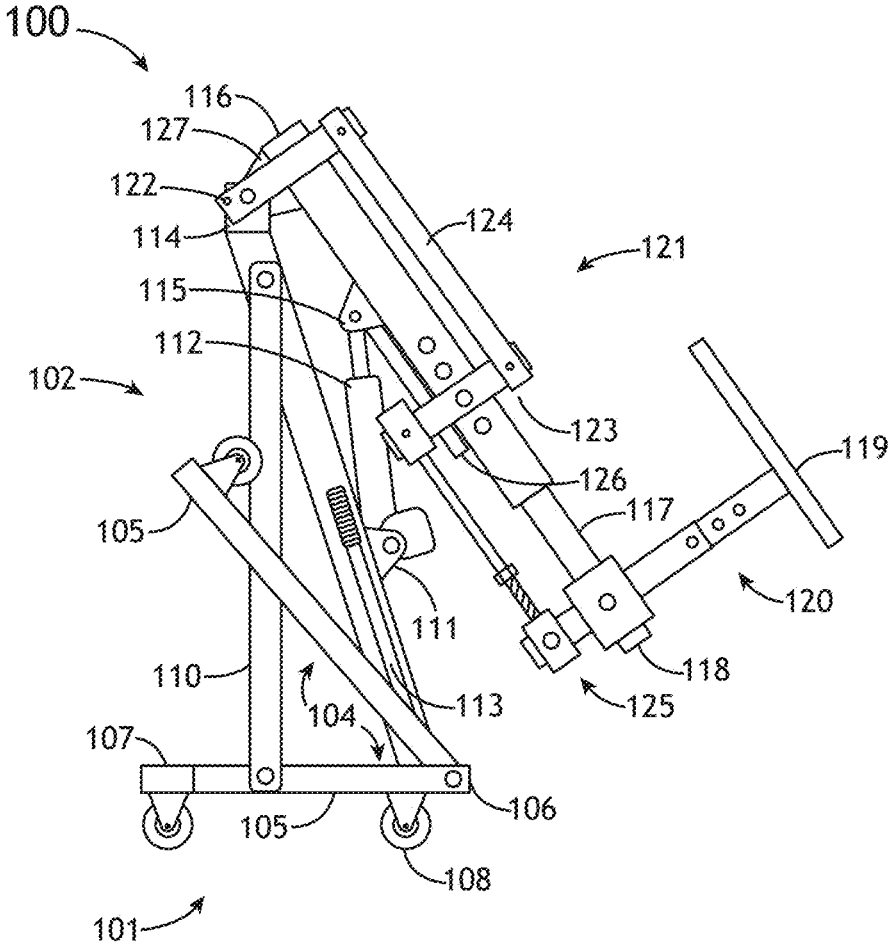
FIG. 1C illustrates an apparatus for lifting a vehicle top in a collapsed arrangement, in accordance with one or more embodiments of the present disclosure.

FIGS. 1A through 1C generally illustrate an apparatus 100 for lifting vehicle tops, in accordance with one or more embodiments of the present disclosure.

In one embodiment, the apparatus 100 includes a base frame 101. The base frame 101 may include one or more legs 104. For example, the one or more legs 104 may be one continuous piece. By way of another example, the one or more legs 104 may include one or more sections 105, where the one or more sections 105 coupled together via a hinge 106.

The base frame 101 may include one or more support sections 107. For example, the one or more support sections 107 may be oriented at a selected angle from the one or more legs 104. For example, the one or more support sections 107 and the one or more legs 104 may form an A-frame for the base frame 101. By way of another example, the one or more support sections 107 may be oriented substantially perpendicular to the one or more legs 104.

The base frame 101 may include one or more sets of wheels 108, where each set of wheels 108 includes one wheel per leg 104. For example, the apparatus 100 may include three sets of wheels 108, with each set of wheels 108 including a wheel for each of the two legs 104. By way of another example, as illustrated in FIG. 1C, the base frame 101 may include enough sets of wheels 105 to allow to a selected section 105 of the one or more legs 104 to fold up for purposes of storage. In this regard, the apparatus 100 is configured to be portable and storable, as the apparatus 100 does not need to be affixed to a particular location during operation and can be moved to any location as necessary while removing and/or installing a vehicle top.

In another embodiment, the apparatus 100 includes a body frame 102. The body frame 102 may include one or more main supports 109. The one or more main supports 109 may be coupled to the frame 102 via one or more frame supports 110. For example, the one or more frame supports 110 may couple the one or more main supports 109 to the one or more legs 104. For instance, where the one or more legs 104 include one or more sections 105, the one or more frame supports 110 may couple the one or more main supports 109 to one or more non-folding sections 105 of the one or more legs 104.

The body frame 102 may include one or more hydraulic pump brackets 111 on the one or more main supports 109. For example, the one or more hydraulic pump brackets 111 may be coupled to the one or more main supports 109 a selected height from a ground surface. One or more hydraulic pumps 112 may be coupled to the one or more hydraulic pump brackets 111. For example, the one or more hydraulic pumps 112 may be manually actuated via a handle 113. By way of another example, the one or more hydraulic pumps 112 may be electrically actuated via a motor. For instance, the motor may be an AC motor or a DC motor. It is noted herein the one or more hydraulic pumps 112 may be considered an actuation device, for purposes of the present disclosure. It is additionally noted herein the one or more hydraulic pump brackets 111 may be considered an actuation device bracket, for purposes of the present disclosure.

In another embodiment, the apparatus 100 includes a lifting arm 103. The lifting arm 103 may be coupled to the body frame 102. For example, the lifting arm 103 may be coupled to a lifting arm bracket 111 on the body frame 102 via a lifting arm mount 127, such that the lifting arm 103 rotates about an axis through a pin coupling the lifting arm bracket 111 to the lifting arm mount 127. For example, the lifting arm bracket 111 may be coupled to the top end of the one or more main supports 109. By way of another example, the lifting arm bracket 111 may be coupled to the front face of the one or more supports 109.

The lifting arm 103 may include one or more hydraulic pump brackets 115. For example, the one or more hydraulic pump brackets 115 may be coupled to the lifting arm 103 a selected distance from the end of the lifting arm 103 where the lifting arm 103 is coupled to the lifting arm bracket 111 of the body frame 102. The one or more hydraulic pumps 112 may be coupled to the one or more hydraulic pump brackets 115, such that the angle of the lifting arm 103 is adjusted via actuation of the one or more hydraulic pumps 112. It is noted herein the one or more hydraulic pump brackets 115 may be considered an actuation device bracket, for purposes of the present disclosure.

The lifting arm 103 may include a main section 116. The lifting arm 103 may include one or more secondary sections 117, where the one or more secondary sections 117 are insertable within the main section 116. For example, a secondary section 117 may be insertable within the main section 116 and held a selected depth within the main section 116 via a pin and a set of adjustment holes. For instance, the selected depth may be adjusted based on which adjustment hole of the set of adjustment holes the pin engages. The lifting arm 103 may include a lifting platform bracket 118. For example, where the lifting arm 103 includes only a main section 116, the lifting platform bracket 118 may attach to the end of the main section 116 substantially opposite to the end where the main section 116 is coupled to the lifting arm bracket 111 of the body frame 102. By way of another example, where the lifting arm 103 includes a secondary section 117 inserted within the main section 116, the lifting platform bracket 118 may attach to the end of the secondary section 117 substantially opposite to the end where the main section 116 is coupled to the lifting arm bracket 111 of the body frame 102.

Figure 2A:
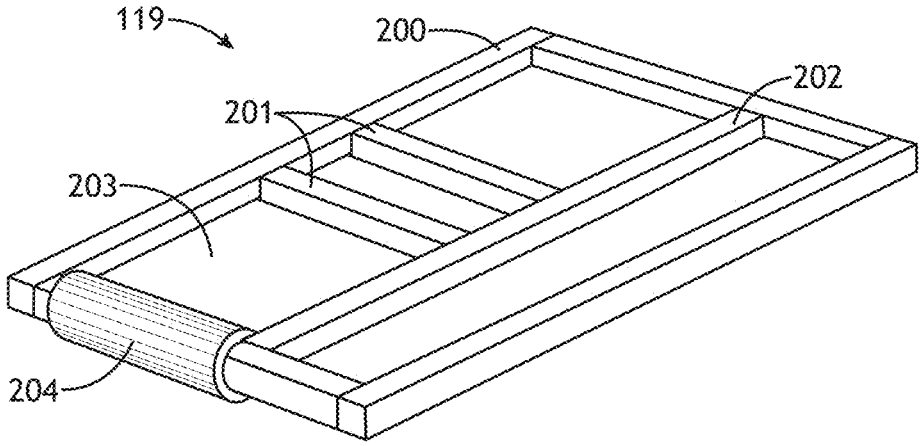
FIG. 2A illustrates an isometric view of a lifting platform of an apparatus for lifting a vehicle top, in accordance with one or more embodiments of the present disclosure.

The lifting arm 103 may include a lifting platform 119. As illustrated in FIG. 2A, the lifting platform 119 includes a frame 200. The frame 200 may include one or more ribs 201 and/or one or more ribs 202 spaced by one or more gaps 203.

The one or more ribs 201, the one or more gaps 202, and/or the one or more gaps 203 may correspond to one or more regions on an underside (e.g., ceiling) of a vehicle top. The one or more ribs 201 and/or the one or more ribs 202 may be covered by a cushion 204. For example, the cushion 204 may be fabricated from a material including, but not limited to, foam, rubber, cloth, or another soft and/or pliant material known in the art to prevent the lifting platform 119 from damaging the underside of the vehicle top.

The lifting arm 103 may include a lifting support 120 coupled to the lifting platform 119. The lifting support 120 may be coupled to the platform bracket 118, such that the lifting support 120 rotates about an axis through a pin coupling the lifting support 120 to the lifting platform bracket 118. For example, the lifting support 120 may be coupled to the lifting platform bracket 118 a selected distance from the end of the lifting support 120 opposite the end of the lifting support 120 coupled to the lifting platform 119.

Figure 2B:
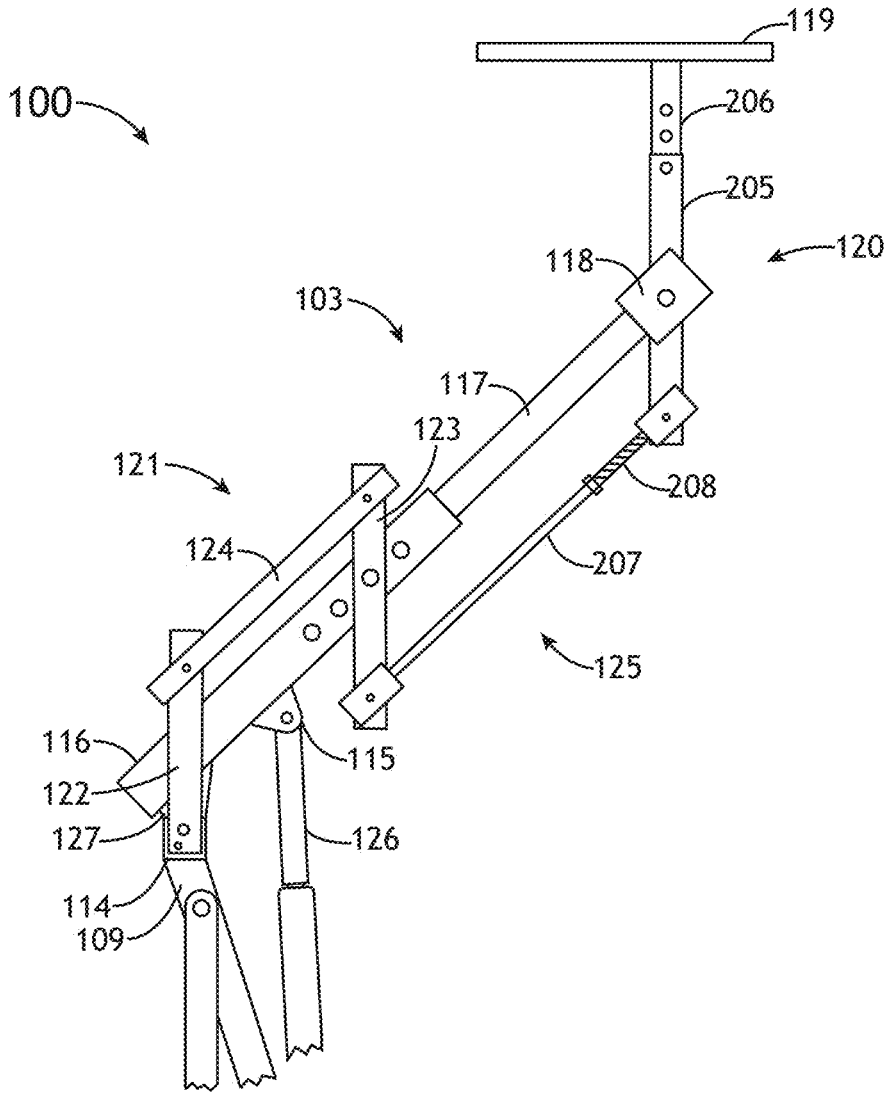
FIG. 2B illustrates a partial side view of an apparatus for lifting a vehicle top, in accordance with one or more embodiments of the present disclosure.
Figure 2C:
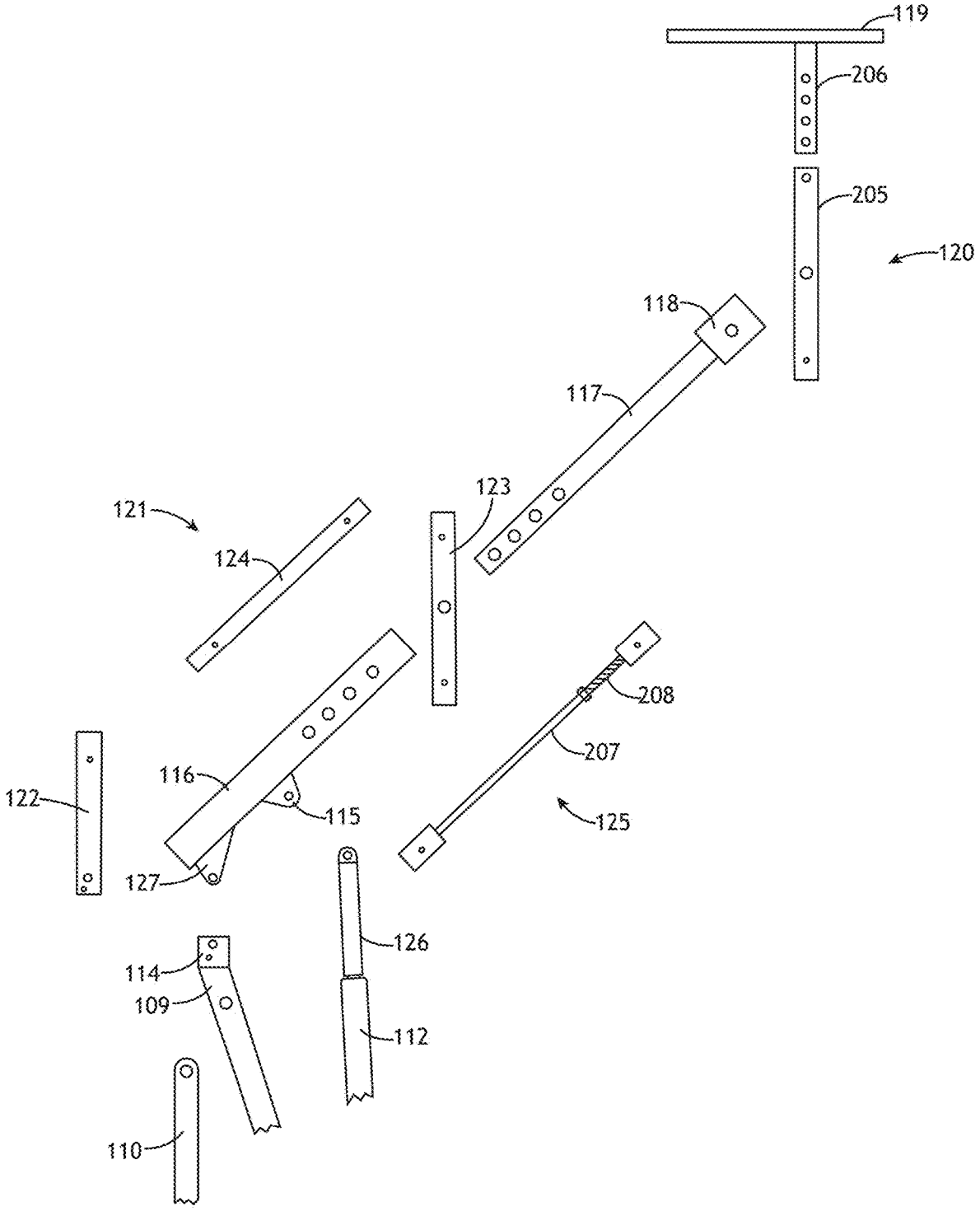
FIG. 2C illustrates an exploded partial side view of an apparatus for lifting a vehicle top, in accordance with one or more embodiments of the present disclosure.

As illustrated in FIGS. 2B and 2C, the lifting support 120 may include a main section 205. The lifting arm 103 may include one or more secondary sections 206, where the one or more secondary sections 206 are insertable within the main section 205. For example, a secondary section 206 may be insertable within the main section 205 and held a selected depth within the main section 205 via a pin and a set of adjustment holes. For instance, the selected depth may be adjusted based on which adjustment hole of the set of adjustment holes the pin engages. It is noted herein, however, that the lifting support 120 may be a single, unbroken component (e.g., a single length of tube). Therefore, the above description should not be interpreted as a limitation on the scope of the present disclosure but merely an illustration.

The lifting arm 103 may include one or more stabilizing linkages 121. For example, the lifting arm 103 may include two stabilizing linkages 121, where the two stabilizing linkages 121 surround the main section 115 and the at least the secondary sections 116. The one or more stabilizing linkages 121 may couple to the lifting arm bracket 114. For example, the one or more stabilizing linkages 121 may be coupled to the exterior of the lifting arm bracket 114 via the pin coupling the lifting arm 103 to the lifting arm bracket 114. In this regard, the linkage assembly may rotate with the lifting arm 103. The one or more stabilizing linkages 121 may couple to the lifting support 120. For example, the one or more stabilizing linkages 121 may couple to the lifting support 120 below the point the lifting platform bracket 118 couples to the lifting support 120. In this regard, the one or more stabilizing linkages 121 may provide additional support to the lifting platform 119.

The one or more stabilizing linkages 121 may include one or more links, such that the lifting platform 119 maintains a substantially planar orientation (e.g., a horizontal orientation substantially parallel to the ground) during rotation of the lifting arm 103 about the axis through the pin coupling the lifting arm 103 to the lifting arm mount 114. For example, the one or more stabilizing linkages 121 may include a link 122 coupled to the exterior of the lifting arm bracket 114 via the pin coupling the lifting arm 103 to the lifting arm bracket 114. By way of another example, the one or more stabilizing linkages 121 may include a link 123 coupled to the exterior of the lifting arm 103 a selected distance from the end of the lifting arm 103 opposite the end of the lifting arm 103 coupled to the lifting arm bracket 103. For instance, where the lifting arm 103 includes a main section 115 and a secondary section 116, the link 123 may be coupled to the lifting arm 103 via the pin securing the secondary section 116 within the main section 115. By way of another example, the one or more links 121 may include a link 124, where the link 124 couples together the links 122, 123. For instance, the end of the link 122 opposite the end of the link 122 coupled to the lifting arm mount 114 may be coupled to the end of the link 123 via the link 124. By way of another example, the one or more stabilizing linkages 121 may include a link 125, where the link 124 couples together the link 123 and the lifting support 120. For instance, the end of the link 123 opposite the end of the link 123 coupled to the link 124 may be coupled to the end of the lifting support 120 via the link 125.

As illustrated in FIGS. 2B and 2C, the link 125 may include a main section 207. The link 125 may include one or more secondary sections 208, where the one or more secondary sections 208 are couplable to the main section 207 (e.g., couplable via a screw adjustment device). It is noted herein, however, that the link 125 may be a single, unbroken component (e.g., a single length of link). Therefore, the above description should not be interpreted as a limitation on the scope of the present disclosure but merely an illustration.

It is noted herein the link 122, the link 123, and the lifting support 120 may retain a substantially parallel orientation while the lifting arm 103 is rotated about the axis through the pin coupling the lifting arm 103 to the lifting arm mount 114. It is additionally noted herein the links 124, 125 may retain a substantially parallel orientation while the lifting arm 103 is rotated about the axis through the pin coupling the lifting arm 103 to the lifting arm mount 114. It is additionally noted herein the angles between the various links of the one or more stabilizing linkages 121, and the lifting support 120, may increase or decrease while the lifting arm 103 is rotated about the axis through the pin coupling the lifting arm 103 to the lifting arm mount 114 to assist the link 122/link 123/lifting support 120 and the link 124/link 125 in maintaining the respective substantially parallel orientations. In this regard, the lifting platform 119 may maintain the substantially planar orientation (e.g., a horizontal orientation substantially parallel to the ground) during rotation of the lifting arm 103 about the axis through the pin coupling the lifting arm 103 to the lifting arm mount 114.

However, it is contemplated the link 122/link 123/lifting support 120 and the link 124/link 125 may not need to maintain respective substantially parallel orientations while still assisting the lifting platform 119 in maintaining the substantially planar orientation (e.g., a horizontal orientation substantially parallel to the ground) during rotation of the lifting arm 103 about the axis through the pin coupling the lifting arm 103 to the lifting arm mount 114. Therefore, the above description should not be interpreted as a limitation on the scope of the present disclosure but merely an illustration.

It is noted herein the one or more stabilizing linkages 121 may include any number of links necessary to allow the lifting platform 119 to maintain a substantially planar orientation during rotation of the lifting arm 103 about the axis through the pin coupling the lifting arm 103 to the lifting arm mount 114. Therefore, the above description should not be interpreted as a limitation on the scope of the present disclosure but merely an illustration.

A sheath 126 may be coupled to the hydraulic pump bracket 115 and/or couplable to the hydraulic pump 112 that prevents the lifting arm 103 from losing altitude under the weight of a vehicle top when in a raised position. Additionally, a block may be installed to prevent the lifting arm 103 from losing altitude under the weight of a vehicle top. For example, a block may be wedged between the lifting arm 103 and a link of the one or more stabilizing linkages 121.

The embodiments of the apparatus 100 illustrated in FIGS. 1A-1C may be further configured as described herein. In addition, the apparatus 100 may be configured to perform any other steps(s) of any of the system and method embodiment(s) described herein.

Figure 3:
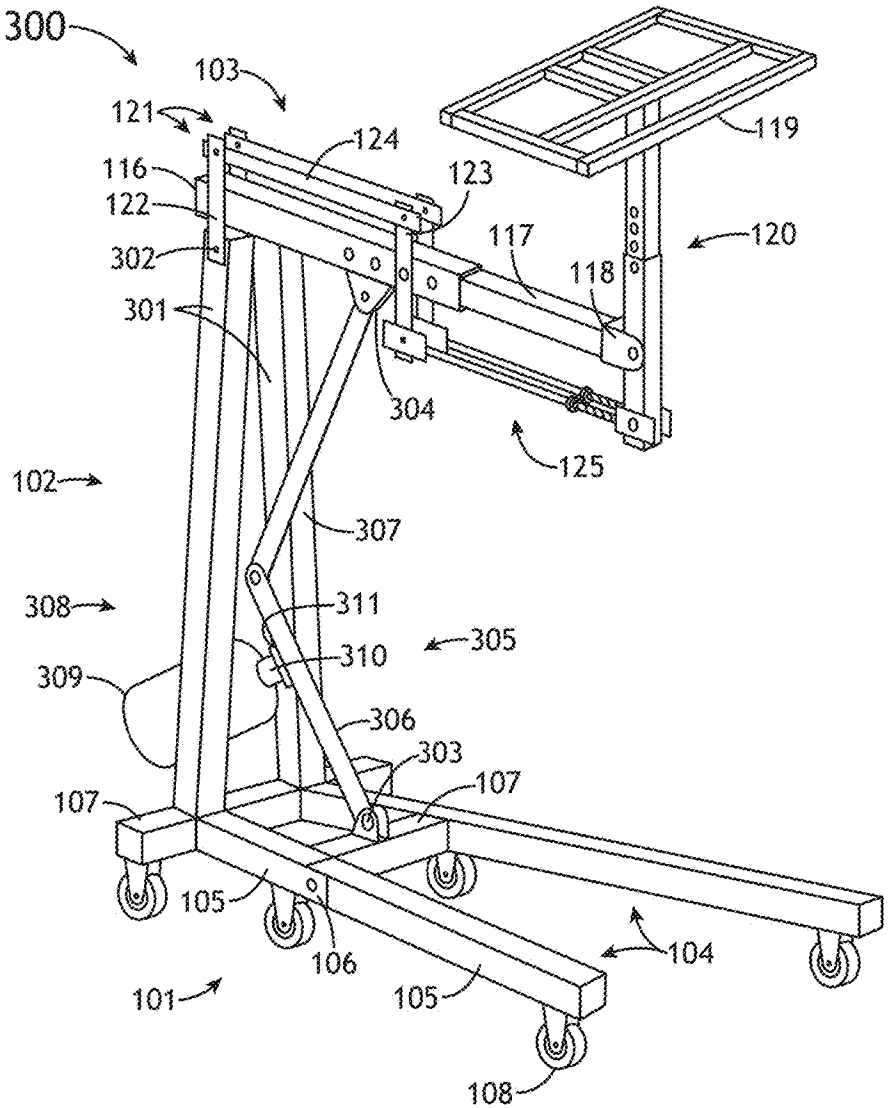
FIG. 3 illustrates an isometric view of an alternative apparatus for lifting a vehicle top, in accordance with one or more embodiments of the present disclosure.

FIG. 3 illustrates an alternative apparatus 300 for lifting a vehicle top, in accordance with one or more embodiments of the present disclosure. It is noted herein that language directed to the apparatus 100 may additionally be directed to the apparatus 300, for purposes of the present disclosure.

In one embodiment, the body frame 102 includes two or more main supports 301. The lifting arm 103 may be coupled to the two or more main supports 301 via a pin at a pivot point 302, such that the lifting arm 103 rotates about an axis through the pin. It is noted herein, however, that the two or more main supports 301 may be coupled to a lifting arm bracket (e.g., the lifting arm bracket 114), such that the lifting arm 103 is additionally coupled to the lifting arm bracket.

The base frame 101 and the lifting arm 103 may include a linkage bracket 303 and a linkage bracket 304. The linkage brackets 303, 304 may be coupled to a linkage 305 including a first link 306 and at least a second link 307. The linkage 305 may be actuated via a screw assembly 308, where the screw assembly includes a motor 309, a threaded rod 310, and a coupler 311. For example, the motor 309 may be an AC motor or a DC motor. By way of another example, the coupler 311 may be coupled to either the first link 306 or the at least the second link 307 of the linkage 305. It is noted herein the angle between the first link 306 and the at least the second link 307 may increase or decrease when the screw assembly 308 is actuated, which causes the lifting arm 103 to rotate about the axis through the pin coupling the lifting arm 103 to the lifting arm mount 114. It is noted herein the screw assembly 308 may be manually-actuated (e.g., via a handle 113). It is additionally noted herein the screw assembly 308 may be considered an actuation device, for purposes of the present disclosure. It is noted herein the linkage brackets 303, 304 may be considered actuation device brackets, for purposes of the present disclosure.

The embodiments of the apparatus 300 illustrated in FIG. 3 may be further configured as described herein. In addition, the apparatus 300 may be configured to perform any other steps(s) of any of the system and method embodiment(s) described herein.

FIG. 4A-4D generally illustrate the removal of a hardtop from a vehicle with the apparatus 100 or the apparatus 300, in accordance with one or more embodiments of the present disclosure.

In one aspect, the various assemblies of the apparatus 100 are configured to fit within the boundaries of the vehicle 401 with a hardtop 402. For example, the base frame 101 may be configured to fit within the interior width of the rear wheels of the vehicle 401. By way of another example, the body frame 102 may be configured to prevent components of the body frame 102 and/or the lifting arm 103 from coming into contact with the vehicle 401 (e.g., a rear door 404 of the vehicle 301, a tailgate of the vehicle 401, a rear hatch of the vehicle 401, or the like). By way of another example, the lifting arm 103 may be configured to fit within the open area between the ceiling of the hardtop 402 to be removed and the floor (e.g., cabin interior, pickup bed, or the like) of the vehicle 401 without coming into contact with the vehicle 401. By way of another example, the lifting arm 103 may be configured to allow the lifting platform 119 of the lifting arm 103 maintain a substantially planar orientation (e.g., a horizontal orientation substantially parallel to the ground) at any angle of the lifting arm 103 when lifting and/or installing the hardtop 402.

Figure 4A:
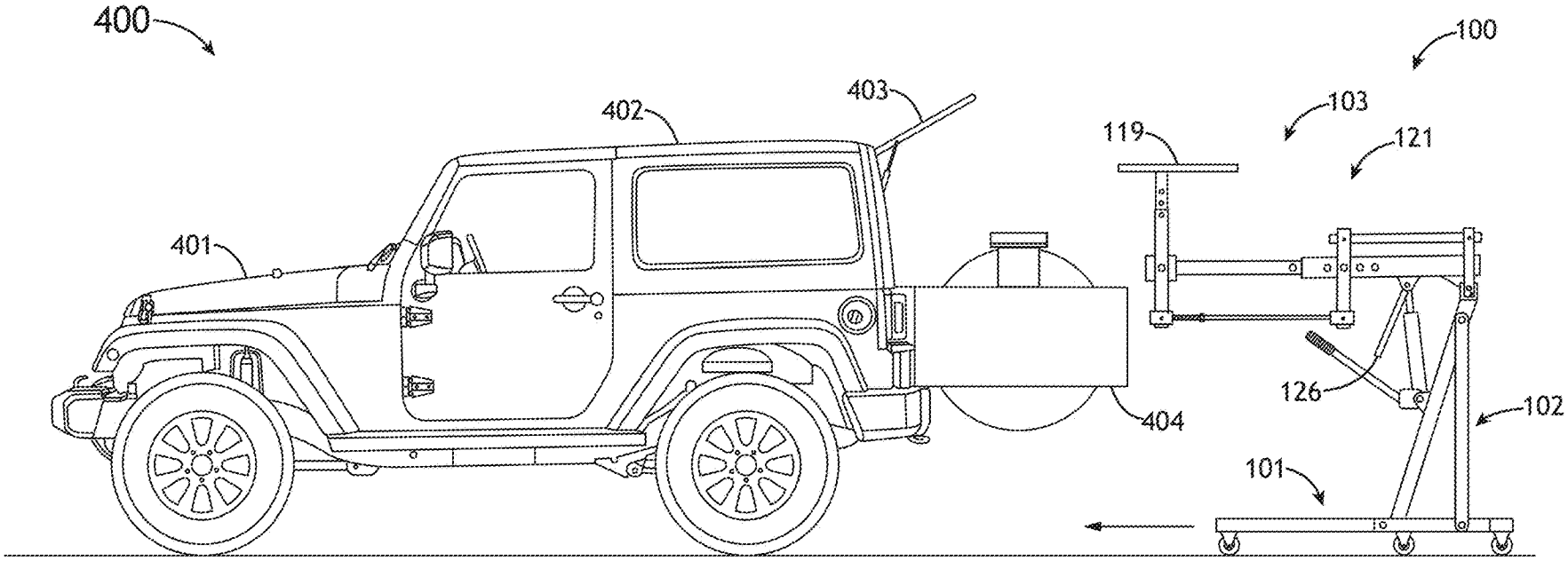
FIG. 4A illustrates an apparatus for lifting a vehicle top with a lifting platform in a lowered position located behind a vehicle with a hardtop, in accordance with one or more embodiments of the present disclosure.

In one embodiment, as illustrated in FIG. 4A, the vehicle 401 and the apparatus 100 are located in a selected space 400 (e.g., garage, work bay, outbuilding, warehouse, factory floor, or the like). The apparatus 100 may be rolled towards the vehicle 100, such that the base frame 101 slides underneath the vehicle 101 and the lifting arm 103 enters underneath the hardtop 404 of the vehicle 401. Prior to engaging the apparatus 100 against the top 402, a rear hatch 403 of the hardtop 402 and/or the vehicle tailgate 404 may be opened for the hardtop 402 to accept the lifting arm 103 of the apparatus 100. It is noted herein, however, that the various assemblies of the apparatus 100 (e.g., the base frame 101, the body frame 102, the lifting arm 103, or the like) may be configured using one or more components such that the apparatus 100 may be utilized within opening the rear hatch 403 of the hardtop 402 and/or the vehicle tailgate 404.

Figure 4B:
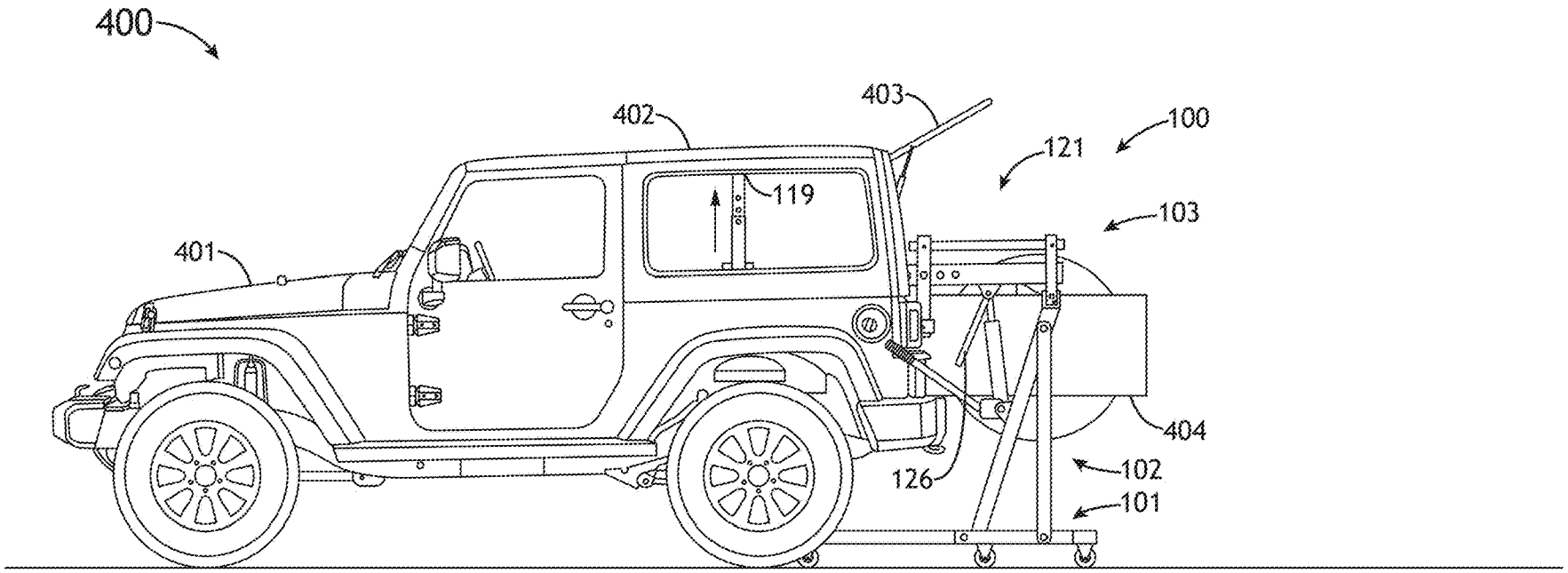
FIG. 4B illustrates an apparatus for lifting a vehicle top with a lifting platform in a lowered position engaging a hardtop of a vehicle, in accordance with one or more embodiments of the present disclosure.

In another embodiment, as illustrated in FIG. 4B, the lifting arm 103 is actuated to engage the underside of the hardtop 402, lifting the hardtop 402 into the air. The one or more stabilizing linkages 121 may allow for the lifting platform 119 to remain in a substantially planar orientation (e.g., a horizontal orientation substantially parallel to the ground) during the lifting process to reduce the possibility of the hardtop 402 becoming unstable and/or falling from the apparatus 100, which may potentially cause property and/or physical damage to the user.

Figure 4C:
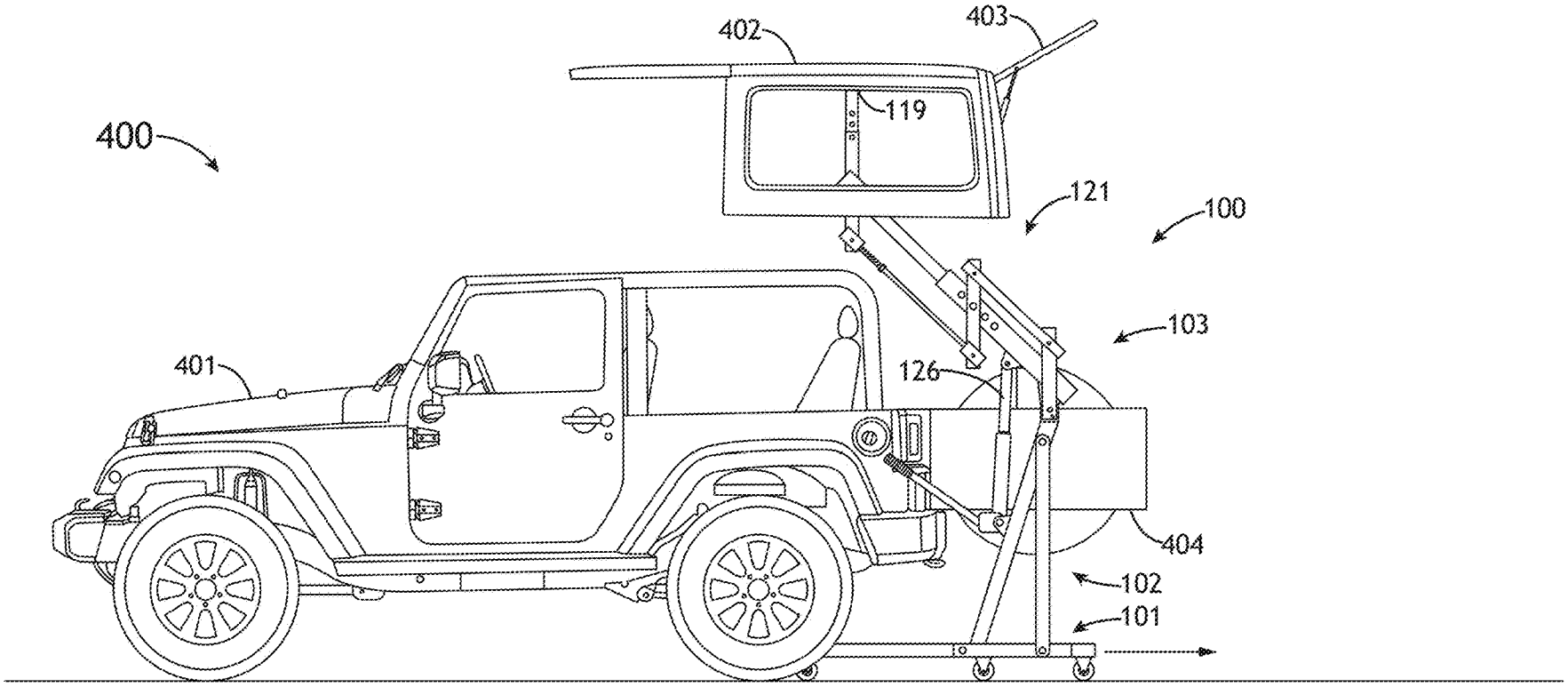
FIG. 4C illustrates an apparatus for lifting a vehicle top with a lifting platform in a raised position lifting a hardtop of a vehicle, in accordance with one or more embodiments of the present disclosure.

In another embodiment, as illustrated in FIG. 4C, the apparatus 100 with the lifted hardtop 402 is rolled away from the vehicle 401. The sheath 126 may be coupled to the hydraulic pump bracket 115 and/or couplable to the hydraulic pump 112 to prevent the lifting arm 103 from losing altitude under the weight of a vehicle top when in a raised position. Additionally, the block may be installed to prevent the lifting arm 103 from losing altitude under the weight of a vehicle top. For example, a block may be wedged between the lifting arm 103 and a link of the one or more stabilizing linkages 121. The hardtop 402 may remain lifted while the apparatus 100 is rolled away from the vehicle 401.

Figure 4D:
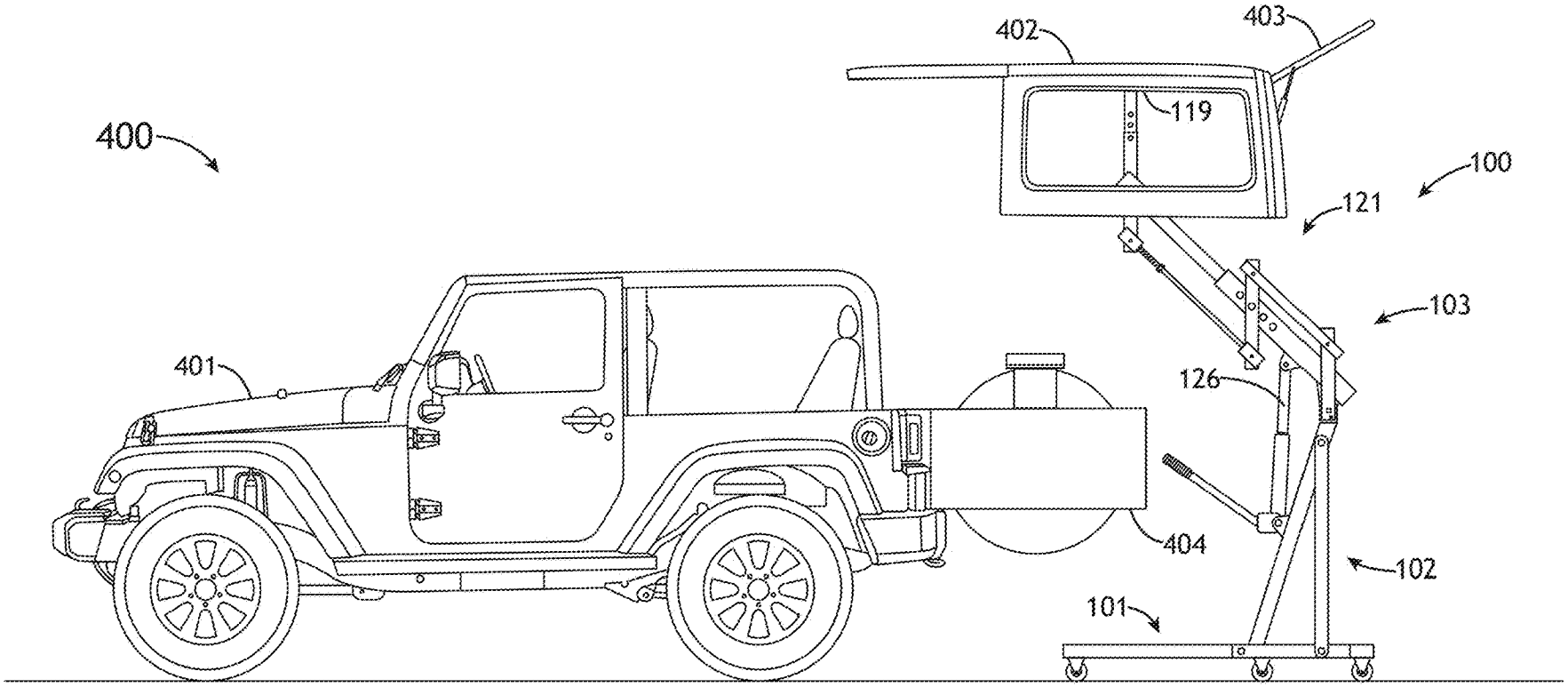
FIG. 4D illustrates an apparatus for lifting a vehicle top with a lifting platform in a raised position located behind a vehicle and lifting a hardtop of the vehicle, in accordance with one or more embodiments of the present disclosure.

In another embodiment, as illustrated in FIG. 4D, the hardtop 402 is stored with the apparatus 100. The hardtop 402 may be stored at the selected location 400 or at a different location. The hardtop 402 may be stored in a raised position on the lifting arm 103 of the apparatus 100. The hardtop 402 may additionally be stored in a lowered position on the lifting arm 103 once the vehicle 401 is no longer in the path of travel of the lifting arm 103.

The hardtop 402 may additionally be removed from the lifting arm 103 of the apparatus 100 and stored separately from the apparatus 100 following removal from the vehicle 401. For example, the apparatus 100 may transport the hardtop 402 to a designated storage shelf, either at the selected location 400 or at a different location. By way of another example, the apparatus 100 may lift the hardtop 402 until the hardtop 402 engages a latching or hook assembly on a ceiling, either at the selected location 400 or at a different location.

In this regard, the apparatus 100 may be utilized in a fully portable and/or storable manner, such that a user is not limited to a particular location when removing and/or installing a vehicle top.

Figure 5A:
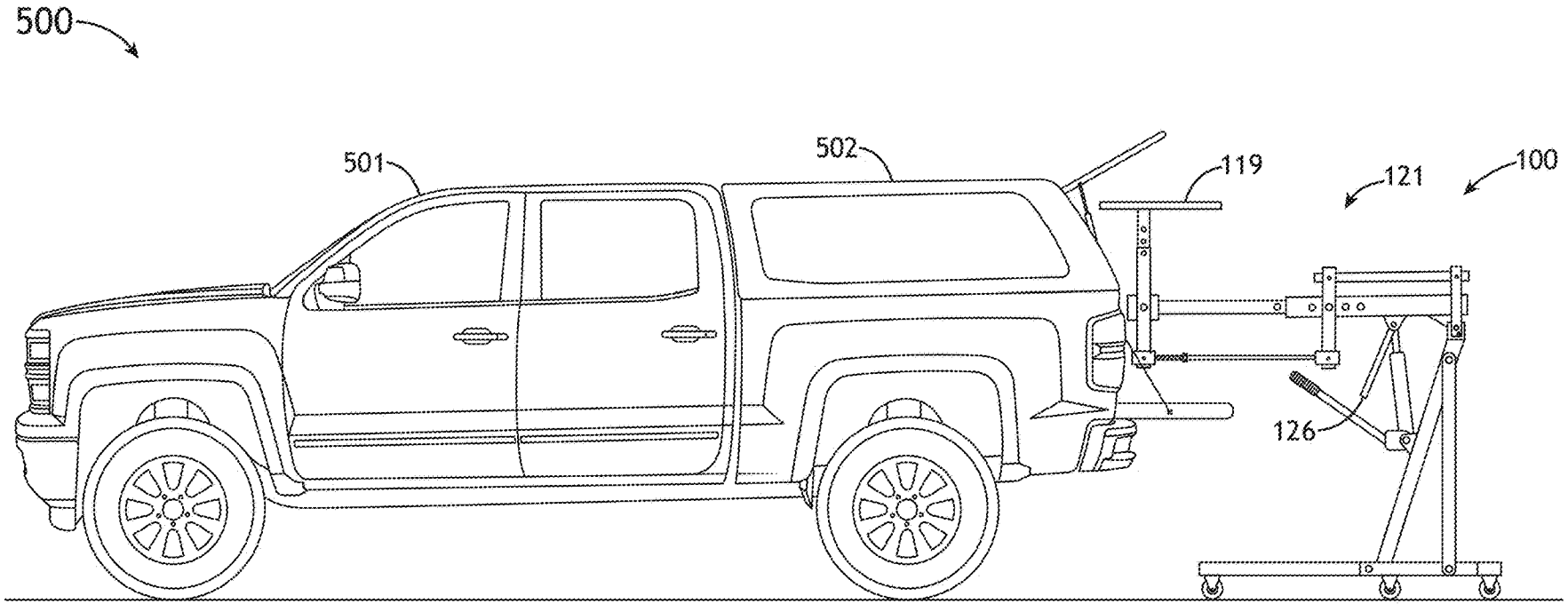
FIG. 5A illustrates an apparatus for lifting a vehicle top with a lifting platform in a lowered position located behind a vehicle with a truck cap, in accordance with one or more embodiments of the present disclosure.
Figure 5B:
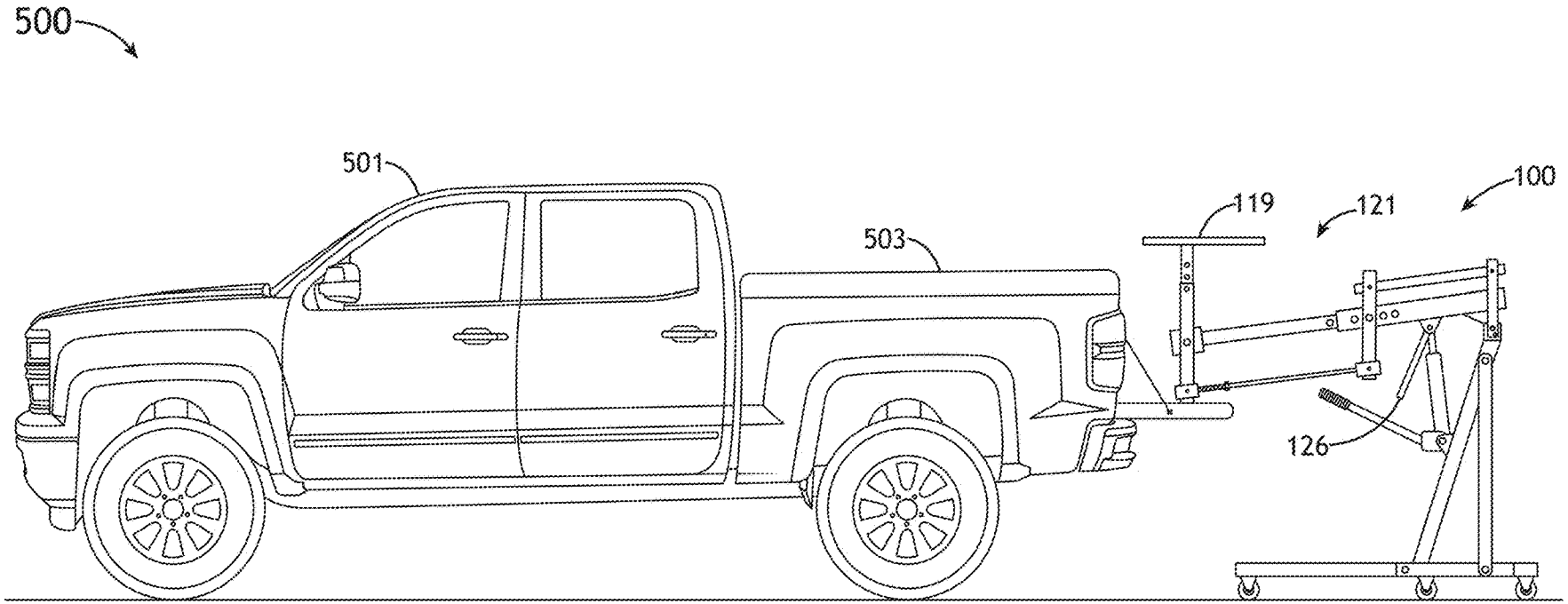
FIG. 5B illustrates an apparatus for lifting a vehicle top with a lifting platform in a lowered position located behind a vehicle with a tonneau cover, in accordance with one or more embodiments of the present disclosure.

Although embodiments of the present disclosure are directed utilizing the apparatus 100 to remove a hardtop from a compact sport utility vehicle (SUV), it is noted herein the apparatus 100 may be utilized to remove any type of vehicle top and/or rack known in the art. As illustrated in FIG. 5A, the apparatus 100 may be utilized to remove a truck cap 502 (e.g., pickup shell, camper shell, truck topper, or the like) of a vehicle 501 (e.g., body-on-frame pickup, unibody pickup, coupe utility, or the like). As illustrated in FIG. 5B, the apparatus 100 may be utilized to remove a tonneau cover 503 from the vehicle 501. The apparatus 100 may be utilized to remove a mid-size SUV or full-size SUV hardtop. The apparatus 100 may be utilized to remove a ladder rack. The apparatus 100 may be utilized to remove a safari rack. The apparatus 100 may be utilized to remove a luggage rack. The apparatus 100 may be utilized to remove a roof-based cargo box or storage bin.

Figure 6:
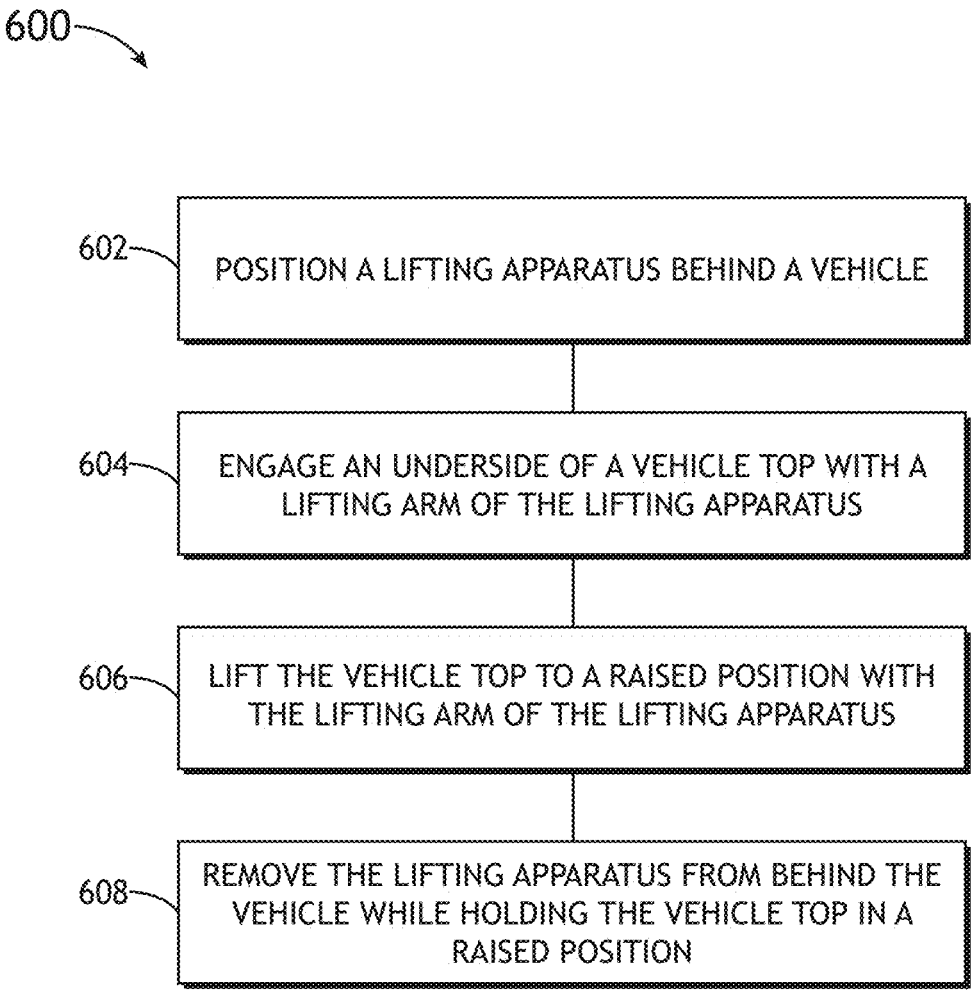
FIG. 6 illustrates a flow diagram depicting a method for removing a vehicle hardtop via an apparatus for lifting a vehicle top.

FIG. 6 illustrates a method 600 for removing a vehicle top, in accordance with one or more embodiments of the present disclosure. It is noted herein that the embodiments directed to the apparatus 100, components of the apparatus 100, the apparatus 300, and/or components of the apparatus 300, as well as embodiments directed to implementing the apparatus 100, 300 at the selected location 400 may additionally be directed to the method 600.

In step 602, the apparatus 100 for lifting the hardtop 402 is positioned behind the vehicle 401. The lifting arm 103 of the apparatus 100 may be inserted into the space between the floor (e.g., cabin interior, pickup bed, or the like) of the vehicle 401 and the underside (e.g., ceiling) of the hardtop 402. The rear hatch 403 of the hardtop 402 and/or the tailgate 404 of the vehicle 401 may be opened prior to inserted the lifting arm 103 into the vehicle space.

In step 604, the lifting arm 103 engages the underside (e.g., ceiling) of the hardtop 402. The lifting support 120 of the lifting arm 103 may be raised until the lifting platform 119 engages the underside (e.g., ceiling) of the hardtop 402.

In step 606, the lifting arm 103 raises the hardtop 402 from the vehicle 401 via the lifting platform 119. Where the lifting arm 103 includes the one or more stabilizing linkages 121, the lifting platform 119 may maintain a substantially planar orientation (e.g., a horizontal orientation substantially parallel to the ground) during rotation of the lifting arm 103 about the axis through the pin coupling the lifting arm 103 to the lifting arm mount 114. The sheath 126 may be engaged following the raising of the hardtop 402 from the vehicle 401 via the lifting platform 119.

In step 608, the apparatus 100 is removed from behind the vehicle 401 while holding or maintaining the vehicle top in a raised position. The apparatus 100 may be stored while maintaining the hardtop 402 in a lifted or lowered position. The apparatus 100 may be utilized to shelf the hardtop 402 and/or engage latching assemblies for the hardtop 402.

Although embodiments of the present disclosure are directed to a pin and/or a pin and set of adjustment holes, it is noted herein the pin could be any fastener known in the art. For example, the fastener may be a clevis pin and cotter pin assembly. By way of another example, the fastener may be a hitch pin and cotter pin assembly. By way of another example, the fastener may be a nut and bolt assembly. By way of another example, the fastener may be a threaded rivet screw. By way of another example, the fastener may be a permanent rivet. Therefore, the above description should not be interpreted as a limitation on the scope of the present disclosure but merely an illustration.

In one embodiment, the one or more hydraulic pumps 112 and/or the motor of the screw assembly 308 may be replaced by one or more servo motors. In another embodiment, the one or more sets of wheels 108 may be driven by one or more servo motors. The one or more servo motors may be AC servo motors or DC servo motors. The one or more servo motors and/or one or more components communicatively coupled to the one or more servo motors (e.g., one or more sensors) may be controlled via a controller. In this regard, the actuation of the lifting arm 103 and/or the motion of the apparatus 100 may be controlled via the controller.

The controller may include one or more processors, where the one or more processors may include any of one or more processing elements known in the art. In this sense, the one or more processors may include any number of microprocessor devices having any number of processing elements configured to execute algorithms and/or instructions. It is noted herein that components of the apparatus 100, 300 may be operable via a single, centralized set of processor or logic elements. It is additionally noted herein that multiple components of the apparatus 100, 300 may include processor or logic elements.

The controller may include memory, where the memory may include any storage medium (e.g., non-transitory memory medium) known in the art suitable for storing one or more sets of program instructions executable by the associated one or more processors. The memory may be housed in a common controller housing with the one or more processors and/or may be located remotely with respect to the physical location of the processors and/or the controller.

The controller may be configured to receive and/or acquire data or information via a transmission medium that may include wireline and/or wireless portions. The controller may be configured to transmit data or information via a transmission medium that may include wireline and/or wireless portions.

The controller may be communicatively coupled to a user interface. The user interface may include a display device, where the display device may include any display device known in the art. The user interface may include a user input device, where the user input device may include any user input device known in the art.

Advantages of the present disclosure include a portable and storable apparatus for lifting vehicle tops. Advantages of the present disclosure also include utilizing the apparatus for lifting vehicle tops on multiple types of vehicle tops and/or covers, where the lifting platform of the lifting arm interacts with the underside (e.g., ceiling) of the vehicle top. Advantages of the present disclosure also include maintaining a substantially planar orientation (e.g., an orientation substantially parallel to the ground) of the lifting arm at any angle during operation when lifting a vehicle top.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

Although a user is described herein as a single figure, those skilled in the art will appreciate that the user may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed:

1. An apparatus for lifting a vehicle top, comprising:

a base frame, comprising:

two or more legs; and one or more support structures couplable to the one or more legs at a selected angle;

a body frame couplable to the base frame, comprising:

one or more main supports; and a lifting arm bracket couplable to the one or more main supports; and a lifting arm couplable to the lifting arm bracket, comprising:

a lifting platform bracket coupled at an end of the lifting arm opposite the lifting arm bracket;

a lifting support couplable to the lifting platform bracket a selected distance from a first end of the lifting support, the lifting support rotatable about an axis through the lifting platform bracket, the lifting support comprising:

a main lifting support section; and a secondary lifting support section, a first end of the secondary lifting support section being insertable in the main lifting support section, the lifting platform being coupled proximate to a second end of the secondary lifting support section, the main lifting support section and the secondary lifting support section being couplable together, the length of the lifting support being adjustable via the main lifting support section and the secondary lifting support section, a lifting platform coupled to the lifting support at a second end of the lifting support, the lifting platform configured to engage an underside of a vehicle top; and one or more stabilizing linkages couplable to the lifting arm bracket, the one or more stabilizing linkages being couplable to the lifting arm a selected distance from the end of the lifting arm, the one or more stabilizing linkages being couplable to the lifting support at the first end of the lifting support, the lifting arm being rotatable about an axis through the lifting arm bracket, the lifting platform maintaining an orientation substantially parallel to a ground surface as the lifting arm rotates about the axis through the lifting arm bracket.

2. An apparatus for lifting a vehicle top comprising:

a base frame, comprising:

two or more legs; and one or more support structures couplable to the one or more legs at a selected angle;

a body frame couplable to the base frame, comprising:

one or more main supports; and a lifting arm bracket couplable to the one or more main supports; and a lifting arm couplable to the lifting arm bracket, comprising:

a lifting platform bracket coupled at an end of the lifting arm opposite the lifting arm bracket;

a lifting support couplable to the lifting platform bracket a selected distance from a first end of the lifting support, the lifting support rotatable about an axis through the lifting platform bracket;

a lifting platform coupled to the lifting support at a second end of the lifting support, the lifting platform configured to engage an underside of a vehicle top;

one or more stabilizing linkages couplable to the lifting arm bracket, the one or more stabilizing linkages being couplable to the lifting arm a selected distance from the end of the lifting arm, the one or more stabilizing linkages being couplable to the lifting support at the first end of the lifting support, a main lifting arm section; and a secondary lifting arm section, a first end of the secondary lifting arm section being insertable in the main lifting arm section, the lifting platform bracket being coupled proximate to a second end of the secondary lifting arm section, the main lifting arm section and the secondary lifting arm section being couplable together, the length of the lifting arm being adjustable via the main lifting arm section and the secondary lifting arm section, the lifting arm being rotatable about an axis through the lifting arm bracket, the lifting platform maintaining an orientation substantially parallel to a ground surface as the lifting arm rotates about the axis through the lifting arm bracket.

3. The apparatus in claim 2, the one or more stabilizing linkages comprising a plurality of links.

4. The apparatus in claim 3, the plurality of links comprising:

a first link couplable to the lifting arm bracket;

a second link couplable to the fastener coupling together the main lifting arm section and the secondary lifting arm section proximate to the intermediate point of the lifting arm;

a third link couplable to the first link and the second link; and a fourth link couplable to the second link and the lifting support proximate to the second end of the lifting support.

5. The apparatus in claim 4, the fourth link comprising:

a main link section; and a secondary link section, the main link section and the secondary link section being couplable together, the length of the fourth link being adjustable via the main link section and the secondary link section.

6. The apparatus in claim 1, the one or more main supports of the body frame being couplable to a support structure of the one or more support structures.

7. The apparatus in claim 1, the one or more main supports of the body frame being couplable to the one or more legs of the base frame via one or more frame supports.

8. The apparatus in claim 1, the one or more legs of the base frame including two or more hinged sections.

9. The apparatus in claim 8, the base frame further comprising:

two or more sets of wheels.

10. The apparatus in claim 9, a first set of wheels being couplable to a first section of the two or more sections, at least two sets of wheels being couplable to a second section of the two or more sections.

11. The apparatus in claim 1, the lifting platform comprising:

a frame; and one or more ribs separated by one or more gaps.

12. The apparatus in claim 11, the lifting platform further comprising:

one or more cushions couplable to at least one of the frame or the one or more ribs.

13. The apparatus in claim 11, at least one of the frame, the one or more ribs, or the one or more gaps corresponding to one or more regions on the underside of the vehicle top.

14. The apparatus in claim 1, further comprising:

a hydraulic pump couplable to the one or more main supports of the body frame and the lifting arm via a set of hydraulic pump brackets, the lifting arm being rotatable about an axis through the lifting arm bracket via the hydraulic pump.

15. The apparatus in claim 14, further comprising:

a sheath couplable to the hydraulic pump, the sheath locking the lifting arm while the vehicle top is in a raised position.

16. An apparatus for lifting a vehicle top comprising:

a base frame, comprising:

two or more legs; and one or more support structures couplable to the one or more legs at a selected angle;

a body frame couplable to the base frame, comprising:

one or more main supports; and a lifting arm bracket couplable to the one or more main supports; and a lifting arm couplable to the lifting arm bracket, comprising:

a lifting platform bracket coupled at an end of the lifting arm opposite the lifting arm bracket;

a lifting support couplable to the lifting platform bracket a selected distance from a first end of the lifting support, the lifting support rotatable about an axis through the lifting platform bracket;

a lifting platform coupled to the lifting support at a second end of the lifting support, the lifting platform configured to engage an underside of a vehicle top;

one or more stabilizing linkages couplable to the lifting arm bracket, the one or more stabilizing linkages being couplable to the lifting arm a selected distance from the end of the lifting arm, the one or more stabilizing linkages being couplable to the lifting support at the first end of the lifting support;

a linkage including a plurality of links, the linkage being couplable to the one or more support structures and the lifting arm via a set of lifting arm linkage brackets; and a screw assembly including a motor couplable to the linkage via a threaded rod and a coupler, the lifting arm being rotatable about an axis through the lifting arm bracket via the screw assembly, and the lifting platform maintaining an orientation substantially parallel to a ground surface as the lifting arm rotates about the axis through the lifting arm bracket.

17. The apparatus in claim 1, the vehicle top being couplable to a vehicle, the base frame being configured to insert between a set of rear wheels on a vehicle, the lifting arm being configured to insert between the underside of the vehicle top and the floor of the vehicle.

* * * * *